US012433348B2

(12) United States Patent
Tam

(10) Patent No.: US 12,433,348 B2
(45) Date of Patent: Oct. 7, 2025

(54) BRASSIERE MANUFACTURED VIA BRA CUP CORE 3D BONDING TECHNOLOGY

(71) Applicant: GRAND GAIN INDUSTRIAL LIMITED, Hong Kong (CN)

(72) Inventor: Kit Fong Kim Tam, Hong Kong (CN)

(73) Assignee: GRAND GAIN INDUSTRIAL LIMITED, Hong Kong (CN)

( * ) Notice: Subject to any disclaimer, the term of this patent is extended or adjusted under 35 U.S.C. 154(b) by 0 days.

(21) Appl. No.: 18/248,159

(22) PCT Filed: May 30, 2022

(86) PCT No.: PCT/CN2022/095992

§ 371 (c)(1),
(2) Date: Apr. 6, 2023

(87) PCT Pub. No.: WO2023/092973

PCT Pub. Date: Jun. 1, 2023

(65) Prior Publication Data

US 2025/0082047 A1 Mar. 13, 2025

(30) Foreign Application Priority Data

Nov. 29, 2021 (CN) ..... 202122962748.8

(51) Int. Cl.
*A41C 3/10* (2006.01)

(52) U.S. Cl.
CPC ..... *A41C 3/10* (2013.01)

(58) Field of Classification Search
CPC ..... A41C 3/10
See application file for complete search history.

(56) References Cited

U.S. PATENT DOCUMENTS 6,165,047 A * 12/2000 Scott ..... A41C 3/10 450/55
6,306,006 B1 * 10/2001 Cheng ..... A41C 3/10 450/57

(Continued)

FOREIGN PATENT DOCUMENTS

CN 200953843 Y 10/2007
CN 201142941 Y 11/2008

(Continued)

OTHER PUBLICATIONS

International Search Report for PCT/CN2022/095992 dated Aug. 25, 2022. China National Intellectual Property Administration, Beijing, China.

(Continued)

*Primary Examiner* — Gloria M Hale
(74) *Attorney, Agent, or Firm* — M&B IP Analysts, LLC

(57) ABSTRACT

The present invention belongs to the technical field of undergarments, and discloses a brassiere, which includes a pair of bra cup cores, and one or more body fabric panel attached with the bra cup cores on the front. The brassiere is formed by connecting both sides via side band fabric panel which are warped to a back of the body, and is sealed and fastened via fastening buckles with or without shoulder straps or fabric panel to support, uplift, and control human breasts. The present invention aims at restoring natural and comfortable beauty of the human breasts via the seamless brassiere fused with the bra cup cores with the 3D bonding technology to minimize joining and stitching causing the itch or discomfort for wearers. The 3D bonding technology of the present invention can be used for the shapes, profiles, and peripheries of different types of 3D bra cup core.

10 Claims, 11 Drawing Sheets

(56) References Cited

U.S. PATENT DOCUMENTS

| | | | | |
|---|---|---|---|---|
| 8,827,765 | B2 * | 9/2014 | Zhang | A41C 3/146 450/39 |
| 8,956,199 | B2 * | 2/2015 | Liu | A41C 3/146 450/38 |
| 2004/0224604 | A1 * | 11/2004 | Luk | A41C 3/10 450/39 |
| 2005/0208875 | A1 * | 9/2005 | Jagaric | A41C 3/144 450/39 |
| 2013/0095728 | A1 * | 4/2013 | Crompton | A41C 3/0007 450/41 |
| 2017/0226691 | A1 * | 8/2017 | Farmer | B32B 7/05 |
| 2017/0290377 | A1 | 10/2017 | Liu | |
| 2022/0248775 | A1 * | 8/2022 | Todaro | A41C 3/144 |

FOREIGN PATENT DOCUMENTS

| | | | |
|---|---|---|---|
| CN | 205624537 | U | 10/2016 |
| CN | 207692981 | U | 8/2018 |
| CN | 214483304 | U | 10/2021 |

OTHER PUBLICATIONS

Written Opinion of the Searching Authority for PCT/CN2022/095992 dated Aug. 25, 2022. China National Intellectual Property Administration, Beijing, China.

* cited by examiner

BRASSIERE MANUFACTURED VIA BRA CUP CORE 3D BONDING TECHNOLOGY

TECHNICAL FIELD

The invention refers to the technical field of undergarments, in particular to a brassiere.

BACKGROUND

Bra cup cores can be formed by two separated left and right bra cups. A joint is provided or not provided in center front gores of the bra cup cores. Or bra cup cores can be a semi/one piece bra cup cores, and a joint thereof is formed between center front gores during a molding process.

The side band fabric panels will be attached to the bra cup cores or molded fabric panels via design, and can be provided with elastic/fabric straps attached to shoulder strap platforms in an upper portion of the bra cup cores or molded fabric panels. Then the shoulder strap platforms will extend from the front to the back of the body and be attached to the side bands. The two ends of the elastic/fabric straps will be attached with fastening buckles to secure the bra cup cores on the breasts and along the chests to the back of the body.

Problems of Current Molding and Fusing Methods

Traditionally, the molded or stitched bra cup cores are assembled on the fabric panels via stitching along the peripheries thereof.

Such method for manufacturing brassieres has been developed for many years. However, the process is time consuming. The fabric panels need to be cut, jointed and stitched by skilled workers. Moreover, the brassieres made in this way look cumbersome, and the joints and seams make wearers feel itchy and dis-comfortable.

Seamless brassieres fused with the bra cup cores have appeared in the market. Generally, the fabric panels will be fused on the cavity side of the bra cup cores to cover human breasts there. The fabric panels can be fused at the concave side or convex side or both sides of the bra cup cores.

At present, one way of such operation is that, the fabric panels will be molded and fused with the bra cup cores with male and female mold heads within one process.

Adhesives will be sprayed on the bonding sides of the bra cup cores. The adhesives as shown in the present invention are sprayed on the concave sides of the bra cup cores. The fabric panels will be placed at the tops of the female fusing mold heads, and the bra cup cores have been placed on the cavities thereof in this place. Then the fabric panels will be molded and fused with the bra cup core within one process.

By virtue of such method, the fabric molding and the bra cup core fusing will be accomplished between a convex profile of the male mold head and the concave profile of the bra cup cores at one time. Therefore, the two profiles need to be matched completely, otherwise, the cavities of the bra cup cores will be squeezed and deformed by the convex profile of the male mold head.

The problem of this method is that different fabrics will have different constructions, physical properties and thermal properties, so that the profiles of the molded fabrics will be changed according to the molding depth and curvature. Therefore, if the convex profile of the male mold head is limited as the concave profile of the bra cup cores. If the depth of the molded fabric panels is too shallow, then the vertexes of the molded fabric panels cannot contact and be fused with the vertexes on the bra cup cores. If the cup depth of the molded fabric panels is too deep, to the contrary, then the excessive fabrics from the molded fabric profiles will become wrinkled or folded in the cavities of the fused bra cup cores.

Some bra cup cores may be manufactured in the shape like this, such as those with shallow bra cup depth and little deviation of the cup periphery, as shown in FIGS. 14*a* and 14*b*. The manufacture for large bra cup cores with deep cup depth and deviation of the cup periphery will become difficult, as shown in FIGS. 15*a* and 15*b*.

The other method is two-step molding and fusing technology. The fabric panels will be molded as the profile of the side surface of the bra cup cores and the bra cup cores will be fused at the side surface thereof.

The adhesives will be sprayed on the bonding sides of the bra cup cores, for example, on the concave side, as shown in the illustrations of the present invention. The fabric panels will be placed on the top of the female fusing mold head, the bra cup cores have been placed on cavities thereof in this place, and then the fabric panels will be fused with the bra cup cores.

The vertexes are the highest point on the convex profile of the molded circular cones. The concave side of the molded circular cones will be arranged vertically inward. The human breast nipples are placed in these places.

Both of the methods have the same difficulty, that is, how to accurately align the vertexes with the two parts relative to the human breast nipples.

As shown in the illustrations of the present invention, the vertexes on the concave sides of the bra cup cores need to be accurately fused with the vertexes on the convex sides of the molded fabric panels, otherwise the two parts will shift in the same or opposite direction relative to the points of the human breast nipples, move left/right and/or up/down. As a result, the bra cup cores fused with the fabric panels will shift left/right and/or up/down relative to the human breasts.

One way to restore the shifted bra cup cores relative to the peripheries of the fused fabric panels is to use larger fabric panels for the fabric molding and the bra cup core fusing, and then to trim off the fabric edge to restore fabric panels fused with the bra cup cores to their original design patterns.

Two points are marked on the board with a distance as the two vertexes of the bra cup cores fused on the fabric panels, and then peripheral carving lines are used on the board as the final fabric patterns relative to the two vertexes. Two convex solid shape modules with vertexes and profiles are used as the concave cavities of bra cup cores. The bra cup cores will be vertically matched with the two vertex marks on the board with vertex positions. Moreover, the two convex shape modules relative to the fabric panels of the fused bra cup cores are fastened on the board in a way of rotation, and the cutting module will take the periphery as its final fabric panels.

No matter whether the vertexes on the bra cup cores are fused on the fabric panels in the correct position, a trimming process is needed to trim off the excessive fabric edges to restore the original design patterns.

The concave sides of the fabric panel fused with the bra cup cores will be placed on the top of the two convex modules by trying to move and match the vertexes corresponding to the nipples on the convex sides of the bra cup cores to the vertexes on the convex sides of the solid modules, and then placing a die cutting module on the carving line on the board to cut off the redundant fabric edge overlapping the carving line.

Because it is difficult to match the positions corresponding to the nipples on the concave sides of the bra cup cores to the vertexes of the covered convex module, a misplacement for the fused fabric panels of the bra cup cores on the top of the convex solid shape module will occur. If the vertexes are shifted between the convex module and the fused fabric panels of the bra cup cores, then the fused fabric panel will be misplaced relative to the grid lines carved on the board relatively. As a result, the fabric panels will be repositioned or punched. The punching module will be placed on the top of the fabric panel of the bra cup cores in a way of aligning a cutting blade of the punching module with the carved grid line, and the fabric edge overlapping the carved grid line will be trimmed off.

The restoring process is feasible. The standard of the restoring process is to accurately place the fused fabric panel of the bra cup cores on the convex solid shape mould, otherwise the shifting of the vertexes on the fused fabric panel of the bra cup cores relative to the patterns of the original fabric panels will be retained.

In case of no joint between the center front gores, it is additionally difficult to align the vertexes of the bra cup cores with single left and right cups. The left and right cups will independently move left/right and/or up/down. As a result, the left and right cups will be separated from or close to each other and/or move up/down relative to the vertexes of the molded fabric panel.

The function of the joint between the center front gores of the bra cup cores is to limit the movement of the breasts from east to west. If the seamless bra is composed of a single left cup and a single right cup, then the control function of the joint between the center cup gores will completely depend on the physical properties and the distance of the fabric panels between these fused cups. Therefore, where the cups should be positioned and fused is crucial.

If the distance between the cups exceeds the tolerance, the current method for restoring the fused fabric decorative cups of the bra cup cores to the original design pattern thereof will be helpless for the bra cup cores with the single left and right cups.

In the process of punching the fabric edge, skilled workers cost time to correctly place the panel of the bra cup cores and additional fabric materials to restore the original pattern, and all additional costs will be added back to the final products.

SUMMARY

The present invention aims at using the 3D bonding technology for the bra cup cores instead of a traditional method for stitching the bra cup cores with the fabric panels, which can minimize the discomfort caused by joining and stitching, so as to propose a more economical, effective and excellent seamless brassiere. In this way, consumers will have a better choice.

A brassiere according to the present invention includes a bra cup core; a molded fabric panel, adhered to concave sides of the bra cup core, and covered a convex side of the bra cup core; at least one piece of foam material, adhered with one layer of the molded fabric panel; side bands, attached from underarm of the bra cup core or the molded fabric panel, and extended to a back of a body; and shoulder straps, attached with and extended from upward sides of the bra cup cores or upper front of the fabric panel, and connected to the side bands near the back of the body.

The shapes of the bra cup cores and the molded fabric panels are defined by the numbers of the peripheries thereof and the three-dimensional shape profile.

In order to achieve the object of the present invention, the following designs are provided: enabling new adhesive materials and a coating machine, a fabric rack, a tool and a clamp for the application of the adhesive to work together with precisely designed fabric panels for molding; disposing the bra cup cores with three-dimensional coordinates (X, Y and Z) around via pop-out notches designated on the fabric periphery; providing the fabric rack with horizontal and vertical reference lines for the alignment and installation of all molds; a reference line on the fused mold head used for placing the bra cup cores and orderly process flow for the fabric panel molding and the bra cup core fusing in machine design; and the sequential process flow used for designing the machine for molding the fabric panel and fusing the bra cup cores. All designs together can fix the vertex alignment between the bra cup cores and the molded fabric panels, so that an additional fabric panel trimming process is not needed.

By virtue of adopting a better workflow and system, the deviation of vertex alignment during fusion, the layout deviation of the fabric panels of the bra cup cores integrated on a panel for die cutting is reduced, and no additional die cutting for fabric edges on the fabric panels does not need, so as to save the time of skilled workers and the cost of additional fabric materials. The seamless brassiere is well matched in the present invention. Such bra will bring comfort, lightness and feeling of control to human breasts.

BRIEF DESCRIPTION OF THE DRAWINGS

In order to make it easier to understand, the present invention is described by accompanying drawings, but is not limited to the accompanying drawings as shown hereinafter.

DETAILED DESCRIPTION

Figure 1:
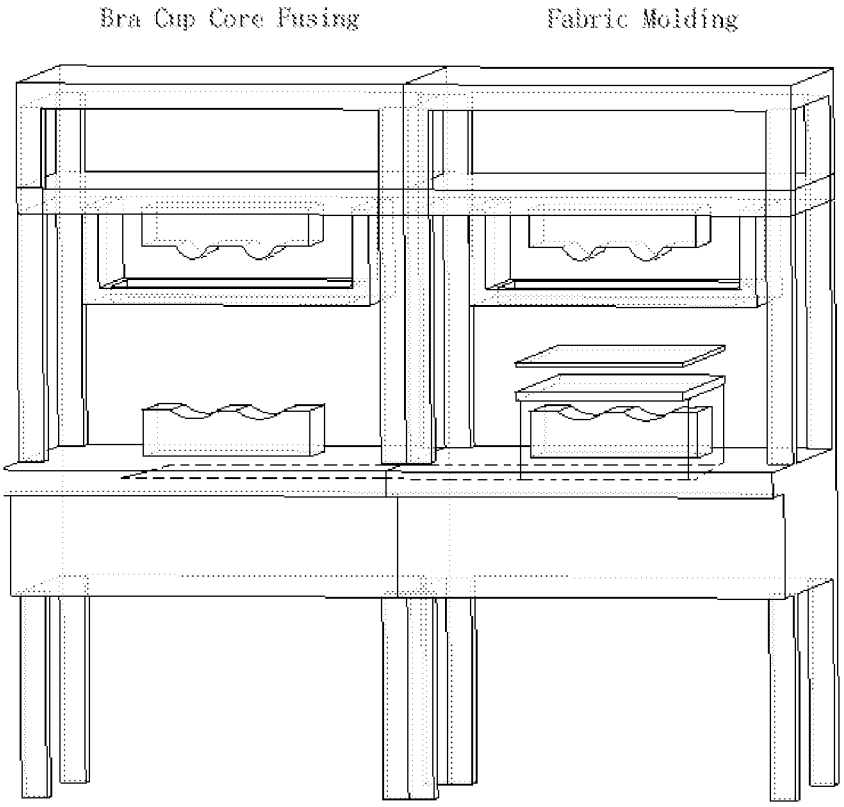
FIG. 1 shows a side view of a fabric panel molding machine on the right adjacent to a bra cup core fusing machine on the left.

The brassiere of the present invention is further described in detailed with reference to the drawings hereinafter in order to understand purposes, structures and functions of the present invention well.

Artificial thermoplastic materials are used for manufacturing bra cup cores and fabric panels. These materials are molded by three-dimensional profile mold heads with convex and concave halves. The bra cup cores and the fabric panels prepared in this way can be in a profile shape, so that they are more comfortable and fit to human breasts.

The molded bra cup cores include one layer or multiple layers of materials. The number of layers is not limited. Generally, a top layer (1) can be an artificial thermoplastic fabric layer, a middle layer (2) can be a thermoplastic polyurethane (PU) foam or fiberfill layer, and a body layer (3) can be an artificial thermoplastic fabric layer. The artificial thermoplastic fabrics can be, for example but are not limited to the materials, such as nylon or spandex, polyester, polyester or spandex, polyester or cotton, synthetic elastane and spandex.

The construction of the bra cup core should be provided with at least one layer (2) or a combination of layers (1), (2) and (3). The combination does not have to be in order or need to be combined with all these layers. It can be multiple layers with different combinations.

Embedded materials can be provided for additional functions between the top layer (1) and the middle layer (2). The embedded materials can be, but are not limited to the materials, such as plastic wire or steel wire with a housing on the bottom cup, fabric or plastic sheet or thermoplastic nets as a sling for stabilizing, supporting and forcing, a layer of foam for buffering and supporting, and oil or air plastic bags for pushing upward. The combination of these embedded materials will depend on requirements, design and function. Adhesives or fusible films or glue will be applied between these layers to provide adhesion to prevent delamination between layers.

One or multiple layers of materials used for the bra cup cores will be handled through the molding process via a series of two halves convex and concave mold heads to form a three-dimensional cup shape to fit the human breasts.

The molded fabric panel includes at least one of top layer fabrics or body layer fabrics. The bra cup cores will be fused in the body layer. The fusing can be on the concave sides of the bra cup cores with the convex sides of the molded fabric panel at the bottom. The fusing can be on the convex sides of the bra cup cores with the concave sides of the molded fabric panel at the top. The fusing can be on both concave and convex parts of the bra cup cores between the molded top fabric panel and the bottom fabric panel.

Molded fabric panel can be made of, but not limited to the materials, such as knitted tubes/opening knitted fabric materials manufactured by Santoni machines. The fabric panel can be made of artificial thermoplastic fabrics, such as nylon/spandex, polyester, polyester/spandex, polyester/cotton, Lyrca and spandex. Due to the advantages of design and workflow for the fabric molding and the bra cup core fusing, it is possible to work with some heat sensitive natural blend cellulose fabrics, such as polyester/cotton, cotton/modal, blend cotton and blend modal fabrics.

The top layer and the body layer of the fabric panel can be molded together or separately, and will be molded with the profiles of the convex side and the concave side of the bra cup cores respectively.

The adhesives need to be pre-sprayed on the bonding sides of the bra cup cores, and be made of geothermal melt polyurethane (PUR) preferably, but not limited to solvent based polyurethane (PU) or thermoplastic polyurethane (TPU) adhesives.

The top/body fabric panel will be cut according to the designed pattern of the designated pop-out notch therearound. A fabric clamps are needed for additional clamping during the fabric molding process.

The bra cup cores and the molded fabric panels used in the present invention need to form into a three-dimensional cup shape before fusing the two components together. Different functional materials can be attached to at least one of the top or body side of the fabric to provide additional functions. The attached materials can be, but are not limited to, silicone resin/polyurethane (PU) resin, which can be a resin covered with flocking materials, and an artificial thermoplastic fabric as a sling to provide additional support and control.

In order to overcome the mentioned difficulties, the workflow, the fabric rack, clamps and tools are designed, and a computer numerical control used for the fabric panel molding machine and the bra cup core fusing machine is redesigned, as shown in FIG. 1.

Figure 2A:
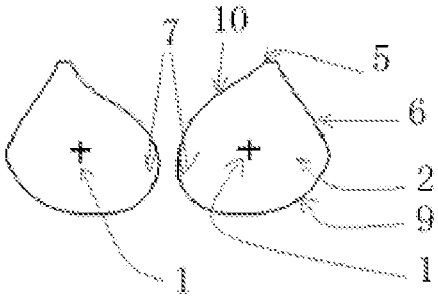
FIG. 2*a* shows a side view of the bra cup core in the form of a single cup with a left cavity and a right cavity.
Figure 2B:
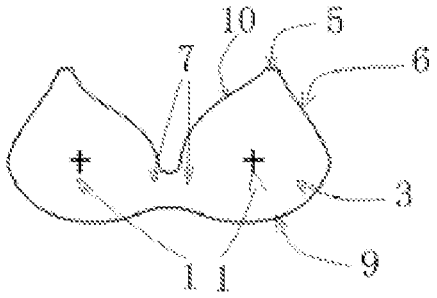
FIG. 2*b* shows a side view of a semi-one piece bra cup core.
Figure 2C:
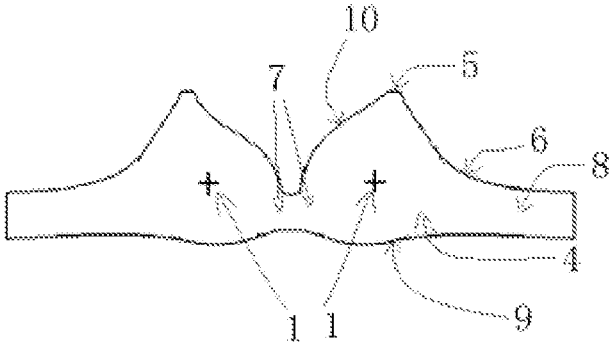
FIG. 2*c* shows a side view of a one piece bra cup core with extended side bands.

The bra cup cores are in different forms, which are limited by the number of periphery thereof and three-dimensional profile. In illustrations of the present invention, FIG. 2 shows different formations, but is not limited to, the bra cup core 2 formed by two separate single left and right bra cups, the semi-one piece bra cup core 3 and a one-piece bra cup core 4 with extended side bands 8.

Correspondingly, the fabric panels are also in different forms, such as being semi one piece covering the body, which are connected with the side bands through stitching or bonding, or being one piece, like knitted tube fabrics, wounding from the front to the back of the body without an opening, and being continuously folded from the middle half part of the transverse side of the fabric, being fused with elastic thermoplastic materials or stitched with elastic straps along the bottom of the longitudinal side of the inner folded fabric, as chest straps for controlling the fitting to the body. The folded fabric panel becomes two layers, the top layer and the body layer. The bra cup cores can be fused between the top layer and the body layer. Or the two layers of fabrics can be fused or sonic welded on the edge of the longitudinal side, and then fused with the elastic thermoplastic materials or stitched with the elastic straps along the longitudinal side. The fabric between the layers becomes the chest strap for controlling the fitting to the body. The joint layer of the fabric panels becomes the top layer and the body layer of the fabric panels, so that the bra cup cores can be fused between the top layer and the body layer.

As shown in FIG. 2*a*, FIG. 2*b*, FIG. 2*c* and FIG. 3, the brassiere in the present invention includes a bra cup core (2, 3 and 4); a molded fabric panel 15, adhered to the concave side of the bra cup core (2, 3 and 4), and covering the convex side of the bra cup core (2, 3 and 4); at least one piece of foam material, adhered with one layer of the molded fabric panel 15; side bands 8, attached from the underarm of the bra cup core (2, 3 and 4) or the molded fabric panel 15, and extending to the back of the body; and shoulder straps 48, attached and extended from the upward sides of the bra cup core (2, 3 and 4) or the upper front of the fabric panel 15, and connected to the side bands 8 near the back of the body.

Figure 3:
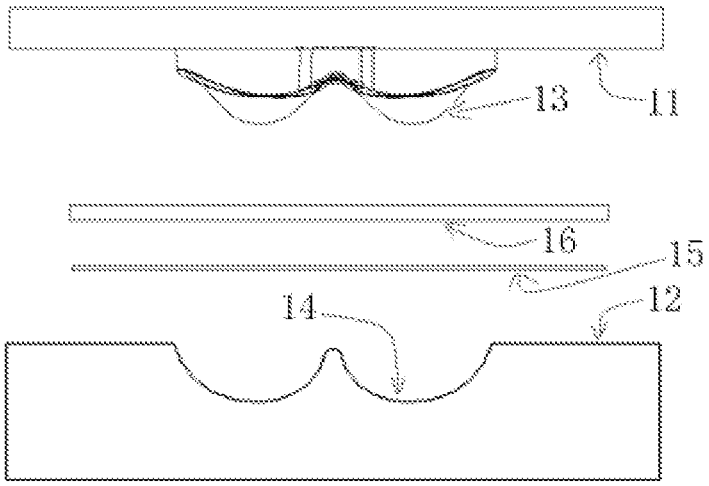
FIG. 3 shows a side view illustrating two halves of bra cup mold heads, and a layer of fabric and foam sheet therebetween.
Figure 4:
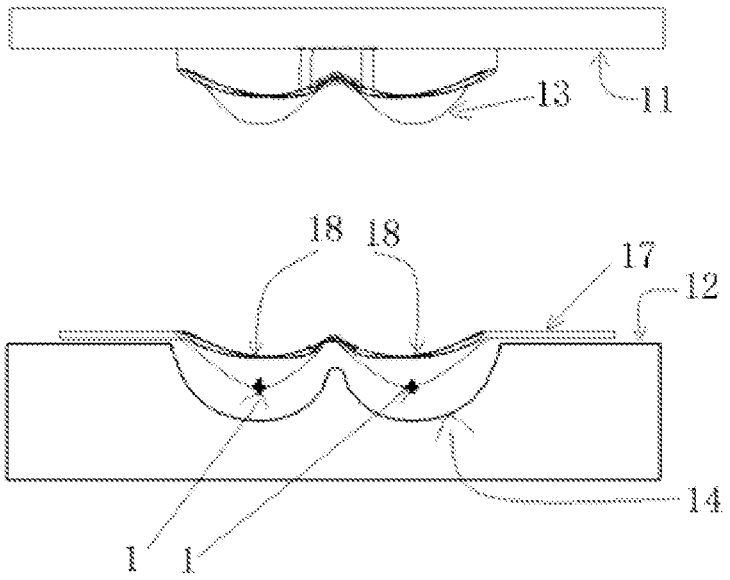
FIG. 4 shows a side view illustrating two halves of bra cup mold heads with a molded bra cup core on the cavities of female mold head.
Figure 11:
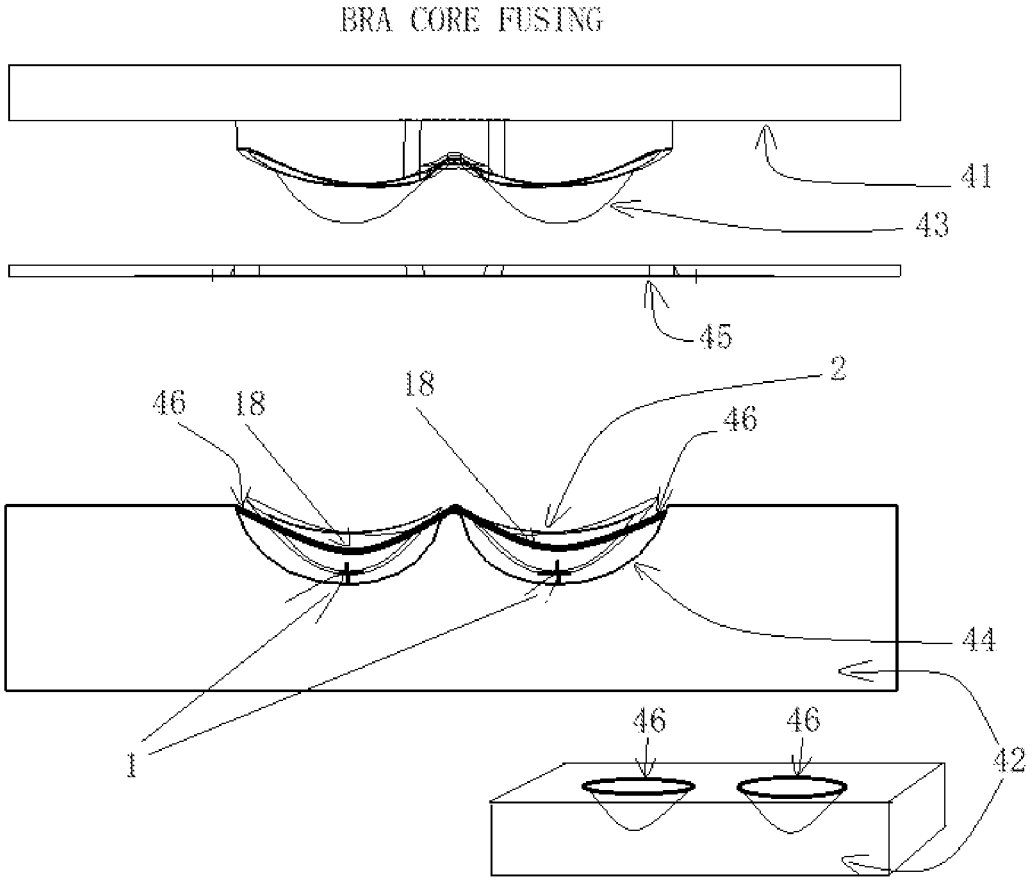
FIG. 11 shows the bra cup cores with single left and right cups at the concave halve of the bra cup core fusing machine.

The bra cup cores (2, 3 and 4) need to be manufactured by the bra cup core molding machine shown in FIGS. 3 and 4. The bra cup cores (2, 3 and 4) pre-sprayed with the adhesives will be placed on the lower halve of fusing mold heads (42 and 44) (as shown in FIG. 11). The fabric panel 15 will be placed on the fabric rack, and then be molded on the right side of the machine as shown in FIG. 1. The molded fabric panel 15 will be transported to the bra cup core fusing machine on the left adjacent side, where, the bra cup cores (2, 3 and 4) have been placed on the cavities of the fusing mold heads, and then the two components will be fused together, as shown in FIG. 1.

The bra cup core (2, 3 and 4) has two cup cavities. The shape of the cup is defined by the periphery and profile thereof, thereby providing coverage and support the breasts of a person.

The periphery of the bra cup cores (2, 3 and 4) includes a under burst 9, a neckline 10 and an underarm 6, which define the cup shape and the covering range of the bra cup. The shoulder strap platforms 5 define the bra cup core (2, 3 and 4) with shoulder traps 48. A joint of two cups can be or can not be provided between the center front gores 7. The joint is used for controlling the position of the cup cavities cover the breasts. The vertex 1, the highest point on the profile of the bra cup, is projected inward vertically into the cup cavities, and the breast nipple will be positioned at this vertex.

The bra cup core (2, 3 and 4) is formed by one or multiple layers of foam sheets 16 laminated with fabric panel 15 on at least one of one side or both sides. The fabric panel 15 will be placed between two halves of mold heads. The male mold head 11 in a convex projected shape 13 can be in different designs, such as even/uneven thickness on the profile thereof to generate different functions on the cavities side of the bra cup core (2, 3 and 4), such as bump for pushup effect and indented lines for visual appearance. The female mold head 12 (as shown in FIG. 3) with concave cavity 14 defines the top view of the bra cup cores (2, 3 and 4), and the projection and profile thereof define the appearance of the bra cup cores (2, 3 and 4) in the brassiere.

The bra cup cores (2, 3 and 4) can provide different functions for the human breasts. Different functional materials can be inserted between the foam layers to provide additional functions. The inserted materials can be, but are not limited to, at least one of a foam layer, a fabric layer or a plastic material layer on the designated area. For example, inserting fabric sling along at least one of the underarm 6 or the under burst 9 of the bra cup cores (2, 3 and 4) to provide force and stability so as to avoid the movement of the breasts, and/or inserting the plastic/steel wire with wired housing into the under burst 9 so as to provide lifting and control, or inserting one or combination of polyester fiber filling or polyurethane foam plastic or artificial fabric or plastic sheet or thermoplastic polyurethane or ethylene vinyl acetate copolymer plastic net or thermoplastic polyurethane plastic wire or steel wire rings with polyester wire housing or at least one of air or oil bags so as to provide different functions. In order to prevent delamination, an adhesive will be applied between the layer materials before molding. The adhesive is preferably but not limited to hot-melt polyamide (PA), thermoplastic polyurethane (TPU) and polyurethane (PUR).

With regard to the molding of the bra cup core (2, 3 and 4), the two halves molds 11 and 12 in FIG. 4 will be closed with the fabric panel 15 and the foam sheet 16 therebetween. The bra cup core (2, 3 and 4) is molded at a temperature of 185° C. to 220° C. for 130 seconds to 160 seconds. The stated time and temperature are not included therein, and are various according to the mold head designs and combination of materials. The untrimmed bra cup cores 17 with two cavities 18 and two vertexes 1 are formed by following the contour profile 17 and spacing between the convex projected shape 13 and the concave cavity 14 as shown in FIG. 4.

Figure 5:
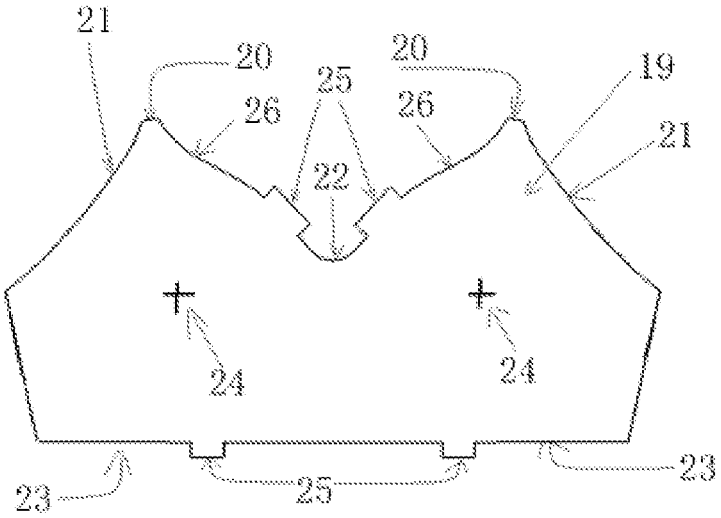
FIG. 5 shows a side view of a precutting fabric panel.

FIG. 5 shows a fabric panel 19 with its perimeter of necklines 26, shoulder strap platforms 20, under arms 21, a gore 22, under burst 23, and vertexes 24. After the peripheries on the molded fabric panel 19 are fused together, and will be positioned relative to the peripheries of the bra cup cores. The pop-out notches 25 will provide additional fabrics held by fabric clamps, such that the fabric clamps will be stressed during the fabric molding. The pop-out notches will be trimmed off after the fusing process.

Figure 6:
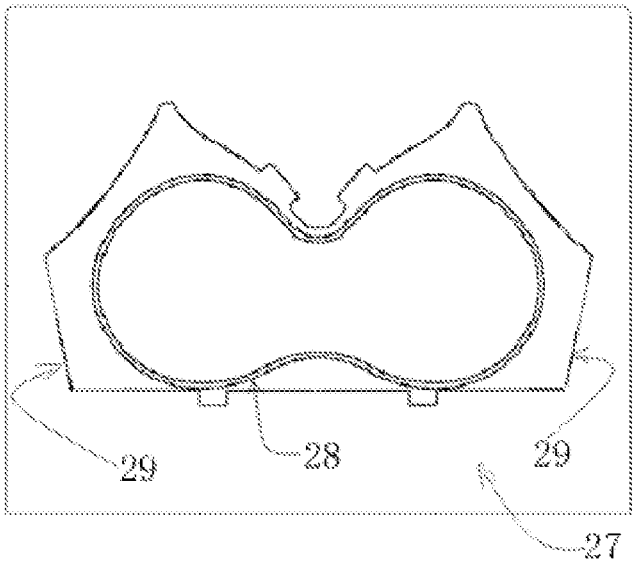
FIG. 6 shows a side view of a fabric rack.

The fabric rack 27 in FIG. 6 shows grid lines of the fabric panel pattern 29. The fabric panel 19 will be placed on the grid lines. In the rack opening 28 for the fabric panel molding, two halves fabric molds 33 and 34 (as shown in FIG. 8) will be closed for the fabric panel molding.

Figure 7:
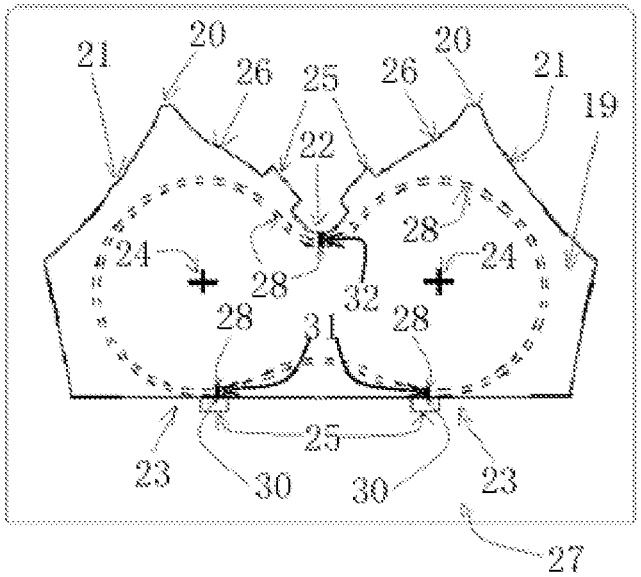
FIG. 7 shows a side view of the placement of the fabric panel on the fabric rack.

As shown in FIG. 7, the fabric panel 19 is placed on the fabric rack 27 to a position relative to the grid lines 29 of the fabric patterns. The fabric panel covers the opening 28 of the fabric rack, where the portion of fabric molding will take place between the two halves of fabric molds 33 and 36. Stress points (32, 31) on the fabric peripheries 22, 30 on the fabric panel 19 are shown in this illustration, where the stress points 31, 32 are shorter than a ram of the opening 28 of the rack. The designated pop-out notches 25 on the fabric periphery provide an additional holding power to prevent the part of the fabric peripheries 22, 30 from being pulled down beyond the opening 28 of the fabric rack, which will lead to a distortion of the profile of the finally molded fabric panel. The stress points on the fabric peripheries 22, 30 are caused by the deviation on the peripheries 6, 5, 9 and 10 of the bra cup cores.

Figure 8:
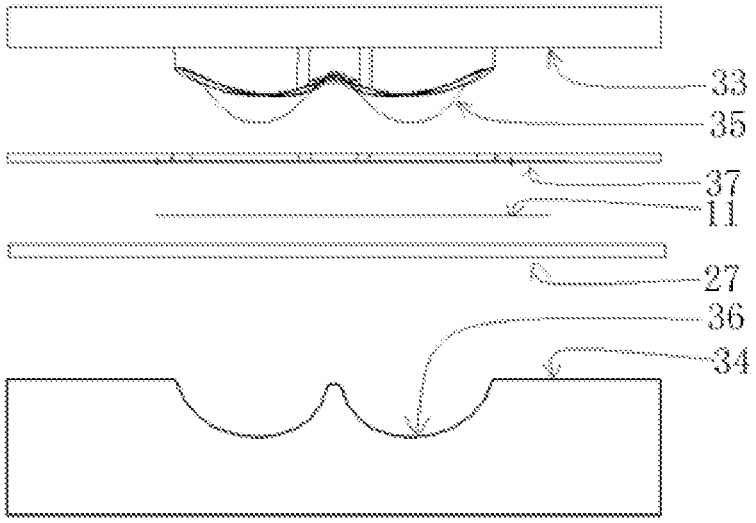
FIG. 8 shows a side view of the fabric panel located on the fabric rack between two fabric mold halves.

As shown in FIG. 8, the fabric panel 19 on the fabric rack 27 will be placed between the fabric mold halves 33, 34. The two mold halves will be closed and the fabric panel will be molded at a temperature of 170° C. to 190° C. for 30 seconds to 50 seconds. The stated temperature and time are not inclusive, and will depend on fabrication and mold head design. The upper halve part of the fabric mold 33 with the projected convex profile 35 is designed to mold out a convex profile matching with the concave side of the bra cup cores, and the lower halve of the fabric mold 34 with the concave profile 36 is provided with an even spacing with respect to the convex side of the upper fabric mold 35.

Figure 9:
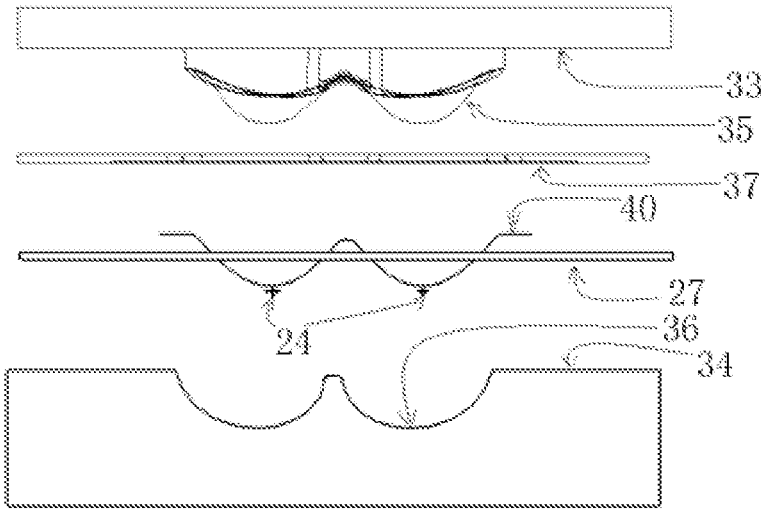
FIG. 9 shows a side view of the molded fabric panel on the fabric rack.

The fabric panel 19 becomes a molded fabric panel 38 with fabric vertexes 24, and is held on the fabric rack 27. In FIG. 9, the fabric rack 27 is transported to the left side of the bra cup cores machine as shown in FIG. 1 for fusing.

Figure 10:
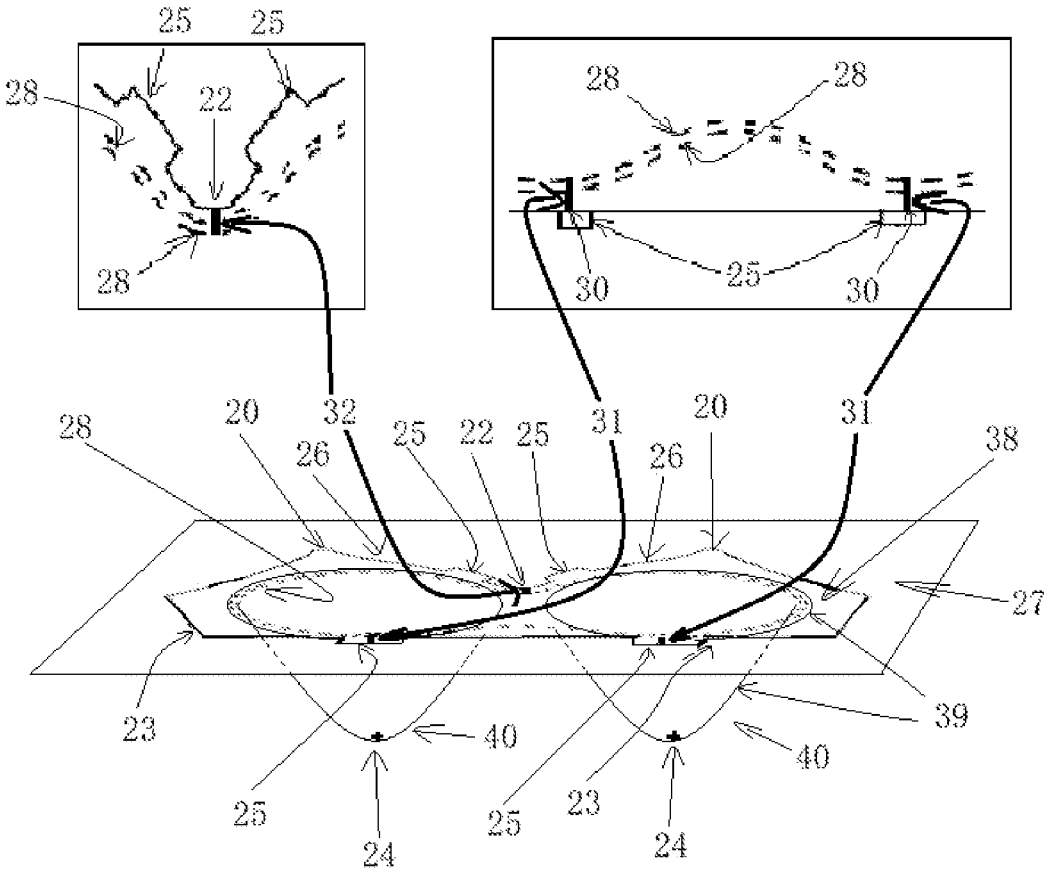
FIG. 10 shows a perspective view of the molded fabric panel on the fabric rack.

FIG. 10 is a perspective view of the molded fabric panel 38 on the fabric rack 27, showing the periphery 39, two fabric cavities 40, and fabric vertexes 24 of the molded fabric panel with a convex profile. The stress points (32, 31) with enlarged view on the fabric peripheries 22 and 30 are shown in this illustration, where the fabric distances 31 and 32 are shorter than the ram of the opening 28 of the fabric panel rack.

FIG. 11 shows that the cup cavities 18 sprayed with adhesives and the cup vertexes 1 on the bra cup core 2 which will be placed on the ram of the cavities 44 of the bottom female mold halve 42 along the reference line 45, and the upper male mold halve 41 with a convex profile 43 which is the same as the cavities 18 of the bra cup core 2.

Figure 12:
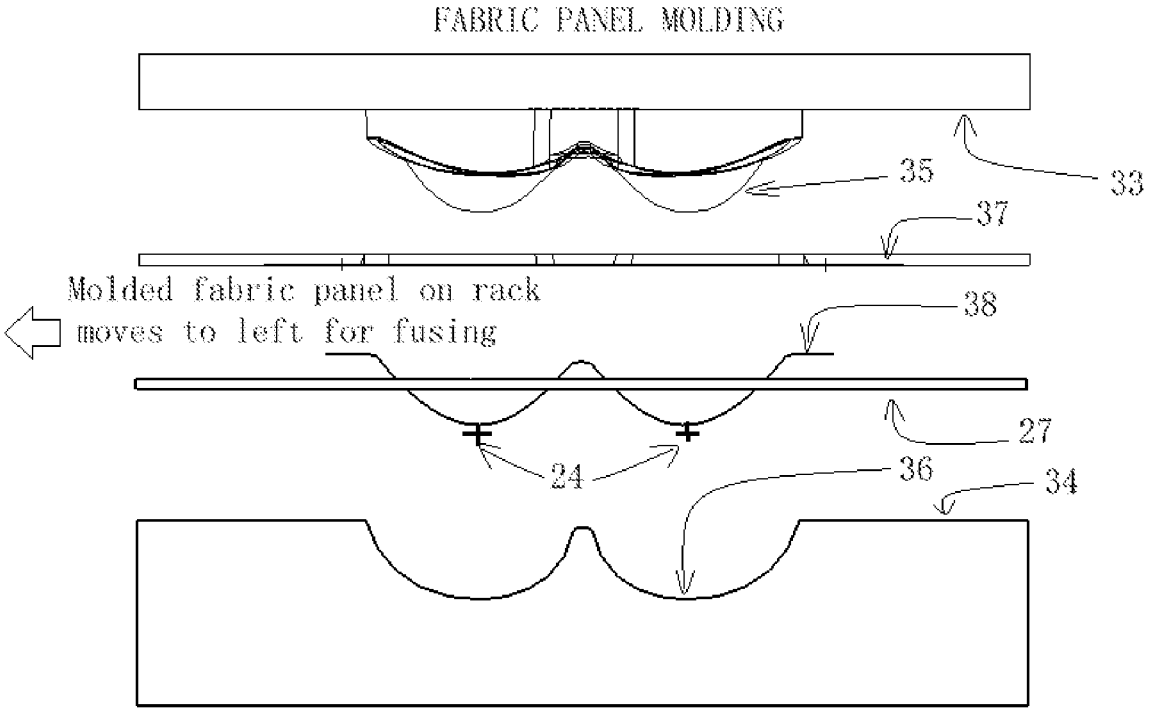
FIG. 12 shows a side view illustrating the molded fabric panel moving to the adjacent left side of the bra cup core fusing machine on the fabric rack.
Figure 13:
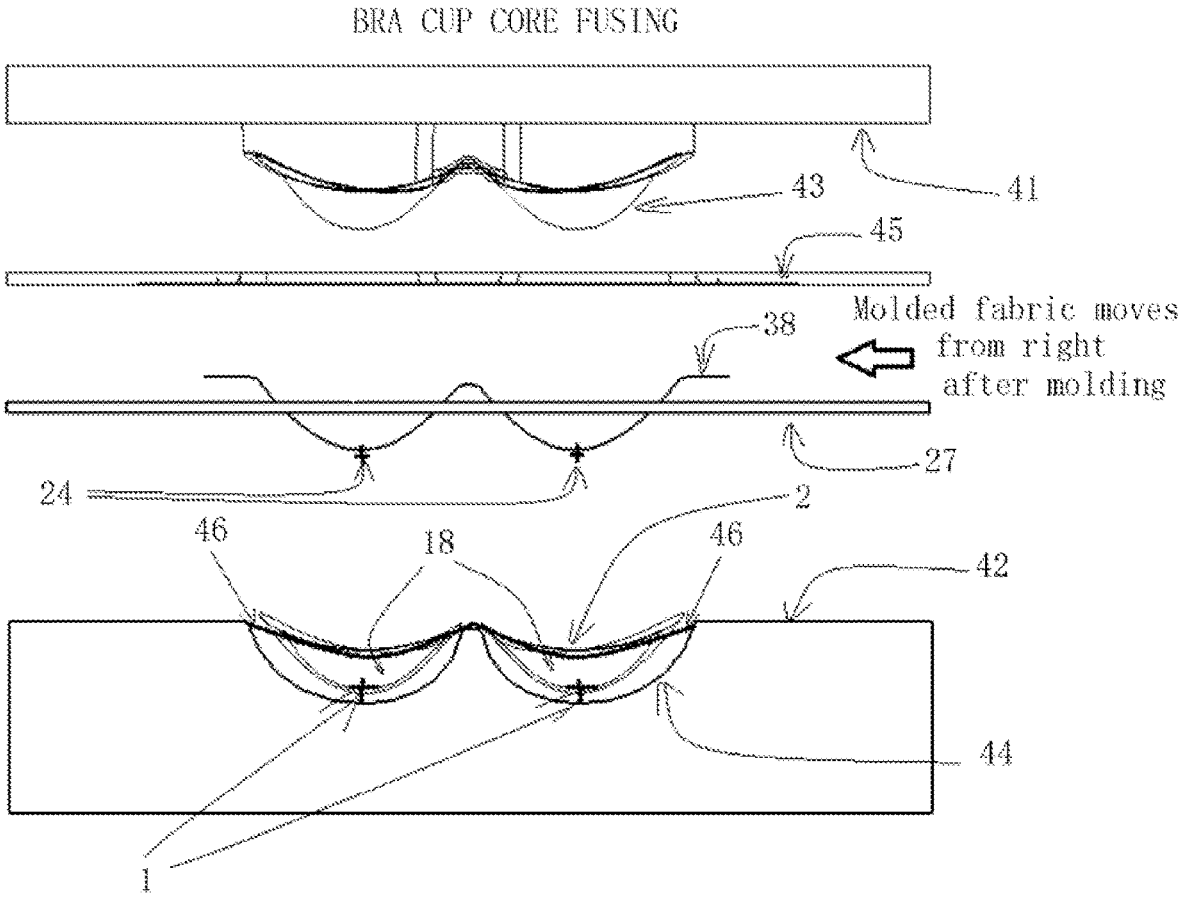
FIG. 13 shows a side view of the molded fabric panel on the fabric rack moved from the right side of a fabric molding machine stop located above the bra cup cores, where the bra cup cores are placed on the cavity halve of the fused mold head, so as to prepare for fusing with the other halve of a convex profile fused mold head.

The molded fabric panel 38 on the fabric panel rack 27 in FIG. 12 moves from the right side of the fabric molding machine on the track to the left adjacent side of the bra cup core fusing machine. In FIG. 13, the bra cup core 2 sprayed with adhesives on the cavity side thereof has been placed on the cavities 44 of the bottom female mold halve 42. At this time, the vertexes on the two components are aligned, and the bra cup core 2 with vertexes 1 are aligned with the molded fabric panel 38 with vertexes 24. When the upper male fusing mold halve 41 and the upper fusing clamp 45 are closed with the lower female molding halve 42, the bra cup core 2 is fused with the molded fabric panel 38.

Figure 14A:
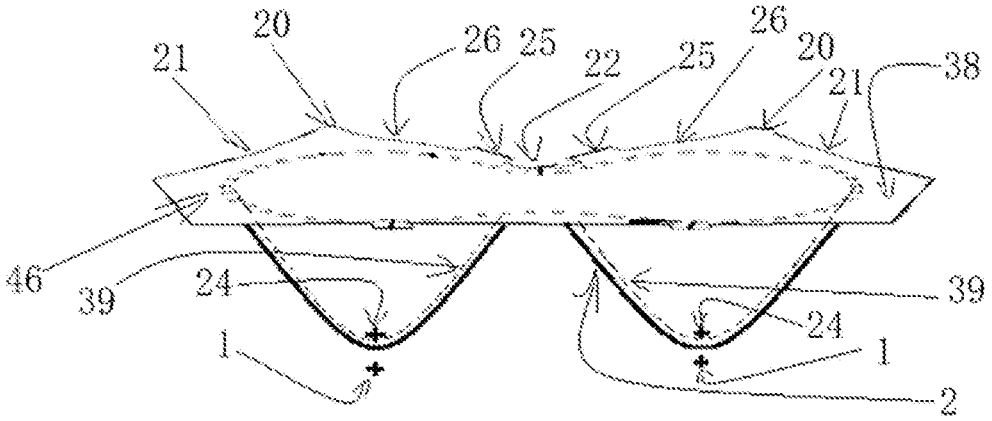
FIG. 14*a* shows a top view of the fused bra cup cores with cup periphery adjacent to a two-dimensional plane of the molded fabric panel, where the shape of the bra cup core likes a cone.
Figure 14B:
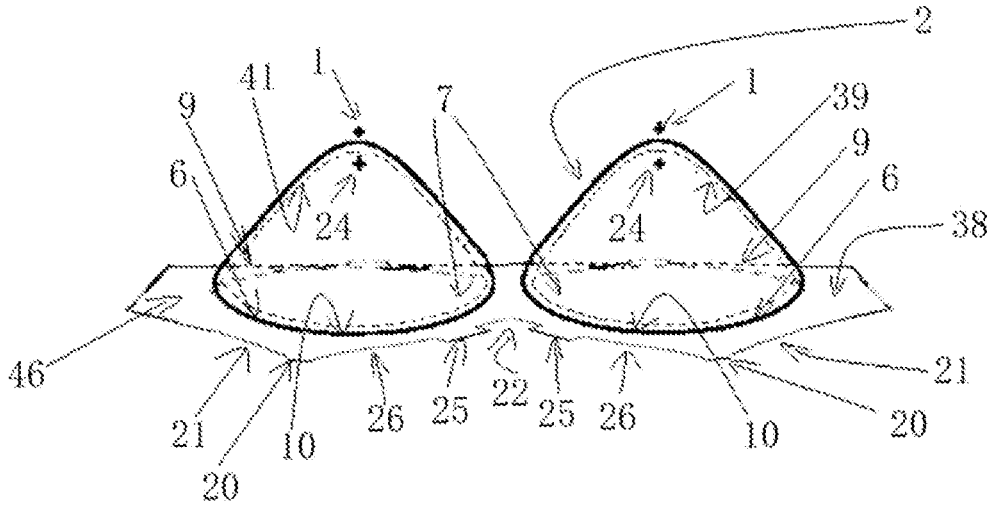
FIG. 14*b* shows a perspective view of the fused bra cup cores with cup periphery adjacent to a two-dimensional plane of the molded fabric panel, where the shape of the bra cup core likes a cone.

The molded fabric panel 38 has the vertexes 24 of the highest points on the molded convex profile 39 and two molded fabric cavities 40. The fabric vertexes 24 will align with the vertexes 1 of the bra cup cores. These components are fused together to form the fused bra cup core with fabric panel 46. FIGS. 14*a* and 14*b* respectively shows the top view and the perspective view of the fused bra cup core with fabric panel 46. The fabric panel is provided with fabric shoulder strap platforms 20, underarms 21 and fabric under bursts 23, which are positioned respectively in the direction of the bra cup cores 5, 6 and 9.

Figure 15A:
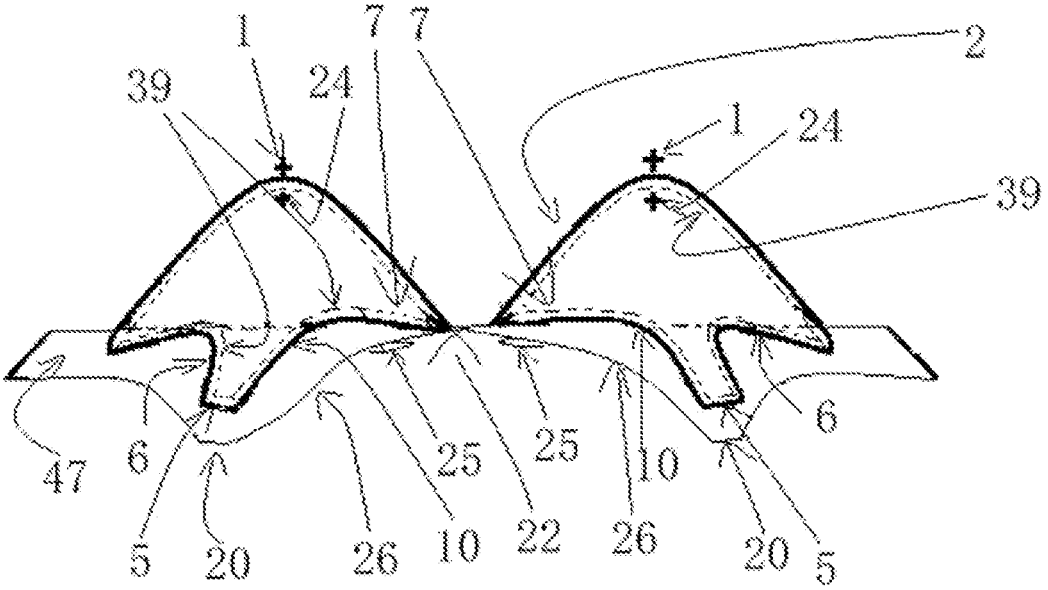
FIG. 15*a* shows a side view and a perspective view of the fused bra cup cores with cup periphery off a two-dimensional plane of the molded fabric panel, and the bra cup cores are in the shape of the three-dimensional periphery.
Figure 15B:
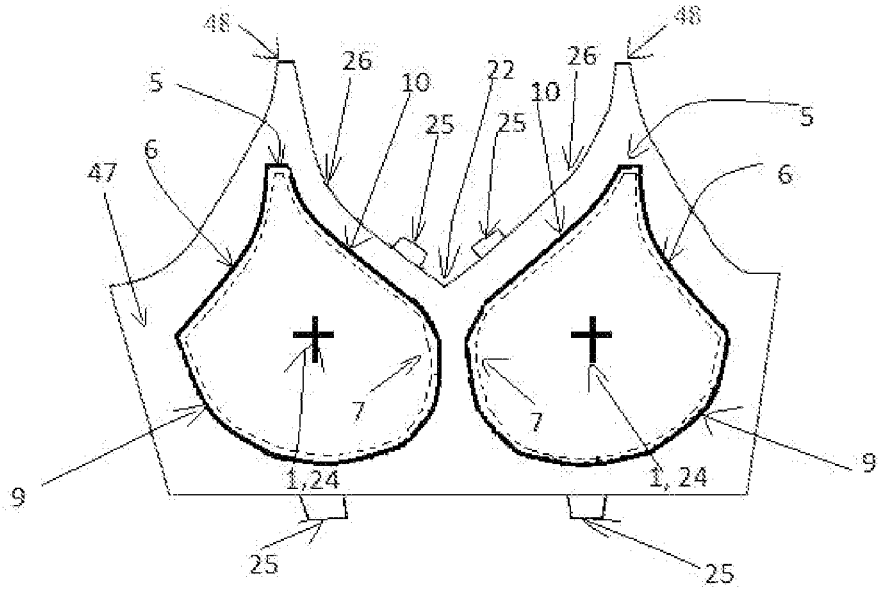
FIG. 15*b* shows a top view of the fused bra cup cores with cup periphery off a two-dimensional plane of the molded fabric panel, and the bra cup cores are in the shape of the three-dimensional periphery.

FIGS. 14*a* and 14*b* respectively shows the top view and perspective view of the fused bra cup core with fabric panel 46 in different forms. FIGS. 15*a* and 15*b* respectively show the side view and top view of the fused bra cup core with fabric panel 47 in different forms. The bra cup core in FIG. 14 is in the shape similar to a cone, and the peripheries 6, 7, 9 and 10 of the bra cups are close to the two-dimensional plane of the fabric panel, which will be easier to fuse than the bra cup core with the cup periphery in three-dimensional form in FIGS. 15*a* and 15*b*. The difficulty comes from the stress points 22 and 32 in the schematic diagram in FIG. 7. The stress on the periphery of the fabric panel is caused by the deviation on the peripheries 5, 6, 7, 9 and 10 of the bra cup core.

The designated pop-out notches are additionally cut/trimmed off by unskilled workers within the least time.

As a result, the fabric panel molded in a smoother and more effective sequential process and the bra cup cores fused in a correct alignment manner on the vertexes of the molded fabric panels and the bra cup cores are provided. The innovative design of the workflow in the present invention, the reference line on the fabric rack for the alignment of the mold heads, the reference line for placing the fabric panel, the reference line on the inclined plane of the cavity of the fusing mold head, the fabric panel molding and the bra cup core fusing under the same group of machines in order, can solve all the problems mentioned about the positioning of the bra cup cores.

The present invention can be applied in another form and process without any specific details in public. The same set of technical knowledge, spirit and concept, innovative design in the workflow, the fabric rack, the tools and the clamps, and computer numerical control in the machine can work together with different formations of the fabric panel molding and the bra cup core fusing. For example, the layout of the machine does not need to be the fabric panel molding machine on the left and the bra cup core fusing machine on the right. The two layers of fabric panel or the continuous fabric are folded and molded with the clamps and the tools to become the top fabric panel and the body fabric panel. The upper and lower fabrics are arranged in a reverse direction, and fused with the half molds. The fusion can occur on the convex side of the bra cup cores with concave side of the top molded fabric panel. In the same machine group with repeated processes for the fabric molding and bra cup fusing machines, the adhesion of the bra cup core can be fused between the molded top and body fabric panel, and the same machine group with additional tools and clamps can be made together with the tube knitted fabrics. Therefore, the present invention should not be limited by the specific disclosure herein, but should be regarded as appended claims.

What is claimed is:

1. A brassiere, comprising:

a bra cup core comprising a foam sheet and a first fabric panel adhered to a convex side of the foam sheet, wherein the bra cup core is provided with a left cup and a right cup;

a second fabric panel adhered to a concave side of the foam sheet;

side bands extending from a position of the brassiere configured to correspond to an underarm of a body to a position configured to correspond to a back of a body; and shoulder straps attached to a shoulder strap platform of the brassiere and extending to a position on the side bands configured to correspond to the back of the body, wherein the shoulder straps are independent polyester elastic band connected with at least one of the first fabric panel or the second fabric panel.

2. The brassiere according to claim 1, wherein the bra cup core has multiple layers of foam sheets, and a functional material is provided between the multiple layers of foam sheets, and the functional material is one or a combination of, polyester fiber fill or polyurethane foam plastic, or synthetic fabric or plastic sheets, thermoplastic polyurethane, or ethylene-vinyl acetate copolymer plastic net, or thermoplastic polyurethane plastic wire, or underwire casing or air and/or oil bags.

3. The brassiere according to claim 2, wherein a fabric is adhered to the convex side or concave side of the foam sheet of the bra cup core.

4. The brassiere according to claim 1, wherein the left cup and the right cup is of a separated structure, and a joint is arranged at center front cores defined by the bra cup core.

5. The brassiere according to claim 1, wherein the left cup and the right cup is of an integrated structure.

6. The brassiere according to claim 1, wherein at least one of the first fabric panel or the second fabric panel is one piece integrally connected with the side bands.

7. The brassiere according to claim 1, wherein at least one of the first fabric panel, or the second fabric panel is an independent part bonded or stitched with the side bands.

8. The brassiere according to claim 1, wherein the shoulder straps are fabrics integrally connected with at least one of the first fabric panel or the second fabric panel.

9. The brassiere according to claim 1, wherein the shoulder straps are fabrics elastically connected with at least one of the first fabric panel or the second fabric panel.

10. The brassiere according to claim 1, wherein the shoulder straps are polyester elastically connected with at least one of the first fabric panel or the second fabric panel.

* * * * *